US011436877B2

(12) United States Patent
Im

(10) Patent No.: US 11,436,877 B2
(45) Date of Patent: Sep. 6, 2022

(54) APPARATUS FOR DETERMINING OVERWORKED CONSUMABLE FOR VEHICLE

(71) Applicant: GLOBIZ CO., LTD., Seoul (KR)

(72) Inventor: Jun Sik Im, Seoul (KR)

(73) Assignee: GLOBIZ CO., LTD., Seoul (KR)

( * ) Notice: Subject to any disclaimer, the term of this patent is extended or adjusted under 35 U.S.C. 154(b) by 193 days.

(21) Appl. No.: 16/727,669

(22) Filed: Dec. 26, 2019

(65) Prior Publication Data

US 2021/0201603 A1 Jul. 1, 2021

(51) Int. Cl.
*G07C 5/08* (2006.01)
*G07C 5/00* (2006.01)

(52) U.S. Cl.
CPC ..... *G07C 5/0808* (2013.01); *G07C 5/006* (2013.01); *G07C 5/008* (2013.01); *G07C 5/085* (2013.01)

(58) Field of Classification Search
CPC ..... G07C 5/0808; G07C 5/006; G07C 5/008; G07C 5/085; G07C 5/0841
See application file for complete search history.

(56) References Cited

U.S. PATENT DOCUMENTS

2014/0358356 A1* 12/2014 Jones ..... G07C 5/0866 701/31.4
2017/0297580 A1* 10/2017 Hanatsuka ..... G08G 1/0141
2018/0229744 A1* 8/2018 Manzari ..... B61L 15/0027

FOREIGN PATENT DOCUMENTS

KR 10-1998-0001364 A 3/1998
KR 10-2004-0048431 A 6/2004
KR 10-2008-0005792 A 1/2008
KR 10-2010-0022753 A 3/2010
KR 10-2010-0035516 A 4/2010
KR 10-1499092 B1 3/2015
KR 10-2015-0049153 A 5/2015
KR 10-2015-0108296 A 9/2015
KR 10-2016-0109616 A 9/2016
KR 10-1682702 B1 12/2016
KR 10-1699884 B1 1/2017
KR 10-2018-0007123 A 1/2018
KR 10-1834851 B1 3/2018

OTHER PUBLICATIONS

Korean Office Action for related KR Application No. 10-2018-0058764 dated May 20, 2019 from Korean Intellectual Property Office.

(Continued)

*Primary Examiner* — Michael V Kerrigan
(74) *Attorney, Agent, or Firm* — Paratus Law Group, PLLC

(57) ABSTRACT

Disclosed is an apparatus for determining an overworked consumable for a vehicle, the apparatus including: a vehicle information receiver that receives vehicle information thorough an On-Board Diagnostics port; an overwork condition determiner that receives vibration information through at least one vibration sensor installed at a specific position in a vehicle and determines at least one of a plurality of overwork condition types on the basis of the vehicle information and the vibration information; and an overworked consumable determiner that determines at least one overworked consumable on the basis of the determined at least one overwork condition type.

11 Claims, 8 Drawing Sheets

(56) References Cited

OTHER PUBLICATIONS

Korean Office Action for related KR Application No. 10-2018-0058765 dated May 21, 2019 from Korean Intellectual Property Office.
Korean Office Action for related KR Application No. 10-2018-0058765 dated Nov. 15, 2019 from Korean Intellectual Property Office.

* cited by examiner

FIG. 4

| OVERWORK CONDITION | ANALYSIS SENSOR | SPECIFIC WEIGHT | DRIVING DISTANCE | DRIVING TIME | CONTRIBUTION DEGREE(%) | OVERWORK DEGREE(%) |
|---|---|---|---|---|---|---|
| 1. WHEN REPEATEDLY DRIVING SHORT DISTANCE | VEHICLE SPEED, CAR BODY ACCELERATION, WHEEL SPEED SENSOR, WHEEL ACCELERATION SENSOR, GPS, VEHICLE POWER | W1 | M1 | T1 | C1 | S1 |
| 2. WHEN DRIVING AREA WITH LOT OF SAND AND DUST | VEHICLE SPEED, CAR BODY ACCELERATION, WHEEL SPEED SENSOR, WHEEL ACCELERATION SENSOR | W2 | M2 | T2 | C2 | S2 |
| 3. WHEN CONTINUOUSLY EXCESSIVE IDLING | VEHICLE SPEED, CAR BODY ACCELERATION, WHEEL SPEED SENSOR, GPS, WHEEL ACCELERATION SENSOR | W3 | M3 | T3 | C3 | S3 |
| 4. WHEN DRIVING OVER 50% OF AREA WITH HEAVY CONGESTION AT TEMPERATURE OVER 30 C | VEHICLE SPEED, CAR BODY ACCELERATION, WHEEL SPEED SENSOR, GPS, WHEEL ACCELERATION SENSOR, TEHMPERATURE SENSOR | W4 | M4 | T4 | C4 | S4 |
| 5. WHEN FREQUENTLY DRIVING ROUGH ROAD (SAND/GRAVEL ROAD, SNOWY ROAD, NON-PAVED ROAD) ETC. | VEHICLE SPEED, CAR BODY ACCELERATION, WHEEL SPEED SENSOR, GPS, WHEEL ACCELERATION SENSOR | W5 | M5 | T5 | C5 | S5 |
| 6. WHEN FREQUENTLY DRIVING MOUNTAIN PATH, UPHILL/DOWNHILL | VEHICLE SPEED, CAR BODY ACCELERATION, GPS, CAR BODY INCLINATION SENSOR, WHEEL SPEED SENSOR, WHEEL ACCELERATION SENSOR | W6 | M6 | T6 | C6 | S6 |
| 7. WHEN USING AS POLICE CAR, TAXI, COMMERCIAL CAR, TOW TRUCK, ETC. | VEHICLE SPEED, CAR BODY ACCELERATION, WHEEL SPEED SENSOR, GPS, WHEEL ACCELERATION SENSOR | W7 | M7 | T7 | C7 | S7 |
| 8. WHEN FREQUENTLY DRIVING AT HIGH SPEED (170KM/H) | VEHICLE SPEED, CAR BODY ACCELERATION, WHEEL SPEED SENSOR, GPS | W8 | M8 | T8 | C8 | S8 |
| 9. WHEN FREQUENTLY REPEATING STOP AND START | VEHICLE SPEED, CAR BODY ACCELERATION, WHEEL SPEED SENSOR, GPS, WHEEL ACCELERATION SENSOR | W9 | M9 | T9 | C9 | S9 |
| 10. WHEN DRIVING SALTY AREA, CORROSIVE AREA, OR COLD AREA | VEHICLE SPEED, CAR BODY ACCELERATION, WHEEL SPEED SENSOR, GPS, WHEEL ACCELERATION SENSOR, TEHMPERATURE SENSOR | W10 | M10 | T10 | C10 | S10 |

FIG. 7

| OVERWORK CONDITION | ANALYSIS SENSOR | SPECIFIC WEIGHT | DRIVING DISTANCE | DRIVING TIME | CONTR BUTION DEGREE(%) | OVERWORK DEGREE(%) |
|---|---|---|---|---|---|---|
| 1. WHEN REPEATEDLY DRIVING SHORT DISTANCE | VEHICLE SPEED, CAR BODY ACCELERATION, WHEEL SPEED SENSOR, WHEEL ACCELERATION SENSOR, GPS, VEH CLE POWER | 1 | M1 | T1 | 1-DP, UNDER 100M 100, 100000이상 0 | S1 |
| 2. WHEN DRIVING AREA WITH LOT OF SAND AND DUST | VEHICLE SPEED, CAR BODY ACCELERATION, WHEEL SPEED SENSOR, WHEEL ACCELERATION SENSOR | 1 | M2 | T2 | 1-DP, UNPAVED ROAD 100, DESERT 90 | S2 |
| 3. WHEN CONTINUOUSLY EXCESSIVE IDLING | VEHICLE SPEED, CAR BODY ACCELERATION, WHEEL SPEED SENSOR, GPS, WHEEL ACCELERATION SENSOR | 3 | M3 | T3 | 1-DP, IDLING 100 | S3 |
| 4. WHEN DRIVING OVER 50% OF AREA WITH HEAVY CONGESTION AT TEMPERATURE OVER 30 C | VEHICLE SPEED, CAR BODY ACCELERATION, WHEEL SPEED SENSOR, GPS, WHEEL ACCELERATION SENSOR, TEHMPERATURE SENSOR | 2 | M4 | T4 | 2-DP, TEMPERATURE>32, 100 & AVERAGE SPEED PER HOUR<10km/h:100, 50: 0 | S4 |
| 5. WHEN FREQUENTLY DRIVING ROUGH ROAD (SAND/GRAVEL ROAD, SNOWY ROAD, NON-PAVED ROAD) ETC. | VEHICLE SPEED, CAR BODY ACCELERATION, WHEEL SPEED SENSOR, GPS, WHEEL ACCELERATION SENSOR | 3 | M5 | T5 | 2-DP, CAR BODY VIBRATION rms>0.5g, 100; rms<0.2, 0: SLIP RATE>0.2, 100; SLIP RATE<0.05, 0 | S5 |
| 6. WHEN FREQUENTLY DRIVING MOUNTAIN PATH, UPHILL/DOWNHILL | VEHICLE SPEED, CAR BODY ACCELERATION, GPS, CAR BODY INCLINATION SENSOR, WHEEL SPEED SENSOR, WHEEL ACCELERATION SENSOR | 2 | M6 | T6 | 1-DP, CAR BODY PITCH ANGLE>30 DEGREE, 100 CAR BODY PITCH ANGLE<5 DEGREE, 0 | S6 |
| 7. WHEN USING AS POLICE CAR, TAXI, COMMERCIAL CAR, TOW TRUCK, ETC. | VEHICLE SPEED, CAR BODY ACCELERATION, WHEEL SPEED SENSOR, GPS, WHEEL ACCELERATION SENSOR | 1 | M7 | T7 | 1-DP, COMMERCIAL VEHICLE USE MADE 100 | S7 |
| 8. WHEN FREQUENTLY DRIVING AT HIGH SPEED (170KM/H) | VEHICLE SPEED, CAR BODY ACCELERATION, WHEEL SPEED SENSOR, GPS | 1 | M8 | T8 | 1-DP, HIGH-SPEED DRIVING OVER 200 100 HIGH-SPEED DRIVING LESS THAN 80 0 | S8 |
| 9. WHEN FREQUENTLY REPEATING STOP AND START | VEHICLE SPEED, CAR BODY ACCELERATION, WHEEL SPEED SENSOR, GPS, WHEEL ACCELERATION SENSOR | 1 | M9 | T9 | 1-DP, 1 TIME/10m 100, 1TIME OVER 1000M 100 | S9 |
| 10. WHEN DRIVING SALTY AREA, CORROSIVE AREA, OR COLD AREA | VEHICLE SPEED, CAR BODY ACCELERATION, WHEEL SPEED SENSOR, GPS, WHEEL ACCELERATION SENSOR, TEHMPERATURE SENSOR | 1 | M10 | T10 | 2-DP, Temp.<-5, COAST: 100, 1TIME UNDER 10: 0; 1TIME OVER 1000: 0 | S10 |

FIG. 8

| ITEM | | VEHICLE A | | VEHICLE B | | VEHICLE C | |
|---|---|---|---|---|---|---|---|
| | | ACCELERATION CONDITION Ms, Ts | COMMON CONDITION Mn, Tn | ACCELERATION CONDITION Ms, Ts | COMMON CONDITION Mn, Tn | ACCELERATION CONDITION Ms, Ts | COMMON CONDITION Mn, Tn |
| ENGINE OIL & OIL FILTER | GASOLINE / LPI | EVERY 7,500km OR 6MONTH | EVERY 15,000km REPLACEMENT 1YEAR | EVERY 7,500km OR 6MONTH | EVERY 15,000km OR 1YEAR | EVERY 7,500km OR 6MONTH REPLACEMENT | EVERY 15,000km REPLACEMENT 1YEAR |
| | DIESEL | EVERY 10,000km OR 6MONTH | EVERY 20,000km REPLACEMENT 1YEAR | | | EVERY 10,000km OR 6MONTH REPLACEMENT | EVERY 20,000km REPLACEMENT 1YEAR |
| AIR CLEANER FILTER | | 7,500km REPLACEMENT (GM) | EVERY 40,000km REPLACEMENT | EVERY 20,000km REPLACEMENT | EVERY 40,000km REPLACEMENT | ANYTIME EXAMINATION OR EVERY 20,000km | EVERY 40,000km REPLACEMENT |
| IGNITION PLUG | NICKEL | 20,000km (COMMON CONDITION 1/2) | EVERY 40,000km REPLACEMENT | | | ANYTIME EXAMINATION | EVERY 40,000km (GASOLINE) REPLACEMENT |
| TIMING BELT | | 80,000km (COMMON CONDITION 1/2) | EVERY 160,000km REPLACEMENT | 80,000km (COMMON CONDITION 1/2) | EVERY 160,000km REPLACEMENT | EVERY 50,000km ANYTIME EXAMINATION | EVERY 160,000km (LPI) REPLACEMENT |
| BRAKE DISC PAD | | ANYTIME EXAMINATION | EVERY 10,000km EXAMINATION | ANYTIME EXAMINATION | EVERY 10,000km EXAMINATION | ANYTIME EXAMINATION | EVERY 10,000km EXAMINATION |
| LOWER ARM BALL JOINT CLEANED | | ANYTIME EXAMINATION | EVERY 30,000km EXAMINATION | ANYTIME EXAMINATION | EVERY 30,000km EXAMINATION | ANYTIME EXAMINATION | EVERY 30,000km EXAMINATION |
| DRIVE SHAFT & BOOT | | ANYTIME EXAMINATION | EVERY 10,000km EXAMINATION | ANYTIME EXAMINATION | EVERY 10,000km EXAMINATION | ANYTIME EXAMINATION | EVERY 10,000km EXAMINATION |
| AIR FILTER FOR AIR CONDITIONER | | ANYTIME EXAMINATION OR 7,500km REPLACEMENT | 15,000km REPLACEMENT | ANYTIME EXAMINATION OR 7,500km REPLACEMENT | 15,000km REPLACEMENT | ANYTIME EXAMINATION OR 7,500km REPLACEMENT | 15,000km REPLACEMENT |
| REAR DIFFERENTIAL OIL | | | | | | EVERY 120,000km | 240,000km |
| TRANSFER CASE(4WD) | | | | | | EVERY 120,000km | EVERY 240,000km |
| AUTOMATIC TRANSMISSION OIL | | EVERY 100,000km REPLACEMENT | EVERY 200,000km REPLACEMENT | EVERY 100,000km REPLACEMENT | EVERY 200,000km REPLACEMENT | EVERY 100,000km REPLACEMENT | EVERY 300,000km REPLACEMENT |

APPARATUS FOR DETERMINING OVERWORKED CONSUMABLE FOR VEHICLE

BACKGROUND

Field of the Invention

The present disclosure relates to an apparatus for determining an overworked consumable for a vehicle and, more particularly, to an apparatus for determining an overworked consumable for a vehicle, the apparatus being able to determine overwork condition types on the basis of vehicle information and vibration information, and determine and provide overworked consumables according to the overwork condition types to a driver.

Related Art

In general, automotive manufacturers or automotive repair shops provide replacement cycles of consumables through a vehicle operation manual and manual and drivers record and manage the replacement cycles of consumables using a memo tool such as a car diary. However, the replacement cycles of consumables that are provided by manufacturers and automotive repair shops are not uniform and the replacement times of consumables that are mounted on vehicles are different, depending on environments, so drivers are confused.

Korean Patent No. 10-1499092 (Feb. 27, 2015) relates to a vehicle diagnosis apparatus, which can precisely measure not only signals from an ECU, but also sensor signals that are not provided by the ECU or require high speed and which can accurately analyze reasons for poor states of parts by simultaneously receiving a low-speed signal from a communication unit for collecting low-speed signals having high mutual connection and a high-speed signal from a waveform measurer for collecting high-speed signals and by displaying, comparing, and analyzing changes in signals according to time.

Korean Patent 10-1834851 (Mar. 28, 2016) relates to an apparatus and method of managing an electric vehicle that gives notice of a battery replacement time. In more detail, disclosed is an apparatus and method including an interface that receives battery-related information from an automotive battery or a battery manager and receives driving information of a vehicle from an ECU (Electronic Control Unit) and a controller that predicts a battery replacement time on the basis of the battery-related information and driving information, and being able to maintaining the performance of the vehicle and parts in optimal states by making a user replace a battery at an appropriate time.

PRIOR ART DOCUMENT

Patent Document

Korean Patent No. 10-1499092 (Feb. 27, 2015)
Korean Patent No. 10-1834851 (Mar. 28, 2016)

SUMMARY

An embodiment of the present disclosure provides an apparatus for determining an overworked consumable for a vehicle, the apparatus determining overwork condition types on the basis of vehicle information and vibration information, and determining and providing overworked consumables according to the overwork condition types to a driver.

An embodiment of the present disclosure provides an apparatus for determining an overworked consumable for a vehicle, the apparatus being able to register places for overwork condition types by providing corresponding places related to GPS information to a vehicle safety diagnosis server when the overwork condition types are determined, and being able to inform a driver that a vehicle arrives around the places for the overwork condition types through an automotive AVN (Audio Video Navigation) by tracking movement of the vehicle.

An embodiment of the present disclosure provides an apparatus for determining an overworked consumable for a vehicle, the apparatus being able to inform a driver of the types of overwork conditions and a severely overworked consumable having the shortest replacement cycle of overworked consumables through an automotive AVN (Audio Video Navigation).

An embodiment of the present disclosure provides an apparatus for determining an overworked consumable for a vehicle, the apparatus being able to calculate a predicted replacement date of an overworked consumable when an overwork condition is generated, and to inform a driver of the replacement date through an OBD.

In embodiments, an apparatus for determining an overworked consumable for a vehicle includes: a vehicle information receiver that receives vehicle information thorough an OBD (On-Board Diagnostics); an overwork condition determiner that receives vibration information through at least one vibration sensor installed at a specific position in a vehicle and determines at least one of a plurality of overwork condition types on the basis of the vehicle information and the vibration information; and an overworked consumable determiner that determines at least one overworked consumable on the basis of the determined at least one overwork condition type.

The overwork condition determiner may receive the vibration information through a wheel acceleration sensor attached to a knuckle, and a car body acceleration sensor and a car body gyro sensor that are attached to a bottom of a lower end of the car body.

The overwork condition determiner may obtain a vehicle speed, a wheel speed, a vehicle temperature, and GPS information as the vehicle information, and obtains wheel acceleration, car body acceleration, and a car body angular speed as the vibration information.

When an overwork condition type is determined, the overwork condition determiner may register a place for the overwork condition type by providing a corresponding place related to GPS information to a vehicle safety diagnosis server.

The apparatus further includes an overwork condition informer that provides the type of a corresponding overwork condition to an automotive AVN (Audio Video Navigation) by detecting that the vehicle arrives around places of overwork condition types by tracking movement of the vehicle.

The overworked consumable determiner may provide the type of an overwork condition and a severe overworked consumable having the shortest replacement cycle of the at least one overworked consumable to an automotive AVN (Audio Video Navigation).

The apparatus further includes a consumable replacement cycle predictor that predicts a replacement cycle by calculating the accumulated amount of overwork degree of at least one overworked consumable on the basis of the overwork condition.

The consumable replace cycle predictor may calculate a predicted replacement date of at least one overworked consumable every time an overwork condition is generated, and may inform a driver of the predicted replacement date through the OBD.

The consumable replace cycle predictor may include: a overwork situation determination module that determines occurrence of an overwork situation on the basis whether a corresponding driving condition corresponds to an overwork condition every time a driving condition of the vehicle changes while the vehicle is driven; a vehicle consumable determination module that determines a problematic vehicle consumable in accordance with the type of the overwork condition; an overwork degree calculation module that calculates an individual overwork degree by reflecting individual contribution degrees according to at least one corresponding overwork situation for a problematic vehicle consumable; and a consumable replacement cycle prediction module that dynamically predicts a replacement cycle of the specific problematic vehicle consumable on the basis of the calculated overwork degree.

The overwork degree calculation module may calculate individual overwork degrees by reflecting individual contribution degrees according to at least one corresponding overwork situation that has occurred up to now after previous replacement of the specific problematic vehicle consumable, and may calculate an overwork degree by summing up the individual overwork degrees.

The overwork degree calculation module may calculate the individual contribution degrees in accordance with how much a driving condition of the vehicle coincides with the overwork situation.

The consumable replacement cycle prediction module may determine a replacement time or a replacement distance as a replacement time and a replacement distance under an overwork situation when the overwork degree is larger than a first overwork degree; determine the replacement time or the replacement distance according to an overwork degree by interpolating a replacement time or a replacement distance under an overwork condition and a replacement time or a replacement distance under a common condition when the overwork degree is smaller than the first overwork degree and larger than a second overwork degree; determine the replacement time or the replacement distance as a replacement time or a replacement distance under a common condition when the overwork degree is smaller than the second overwork degree; calculate a remaining replacement time or a remaining replacement distance using the replacement time or the replacement distance and a driving time or a driving distance up to now after previous replacement of a consumable; and give notice of a replacement time by transmitting the remaining replacement time or the remaining replacement distance to a user terminal.

The consumable replacement cycle prediction module may reduce the replacement lifespan by reflecting the calculated overwork degree to a replacement lifespan corresponding to a replacement time or a replacement distance of the specific problematic vehicle consumable.

The consumable replacement cycle prediction module may determine the replacement lifespan by interpolating a replacement lifespan under an overwork condition and a replacement lifespan under a common condition in accordance with the overwork degree.

BRIEF DESCRIPTION OF THE DRAWINGS

FIG. 4 is a table showing examples of overwork condition types determined on the basis of vehicle information and vibration information in an overwork condition determiner of the apparatus for determining an overworked consumable for a vehicle shown in FIG. 2.

FIG. 7 is a diagram showing an example of contribution degrees set in advance for overwork situations that occur in driving of a vehicle.

FIG. 8 is a diagram showing maintenance target items and an example of changed replacement times thereof.

DETAILED DESCRIPTION

Figure 1:
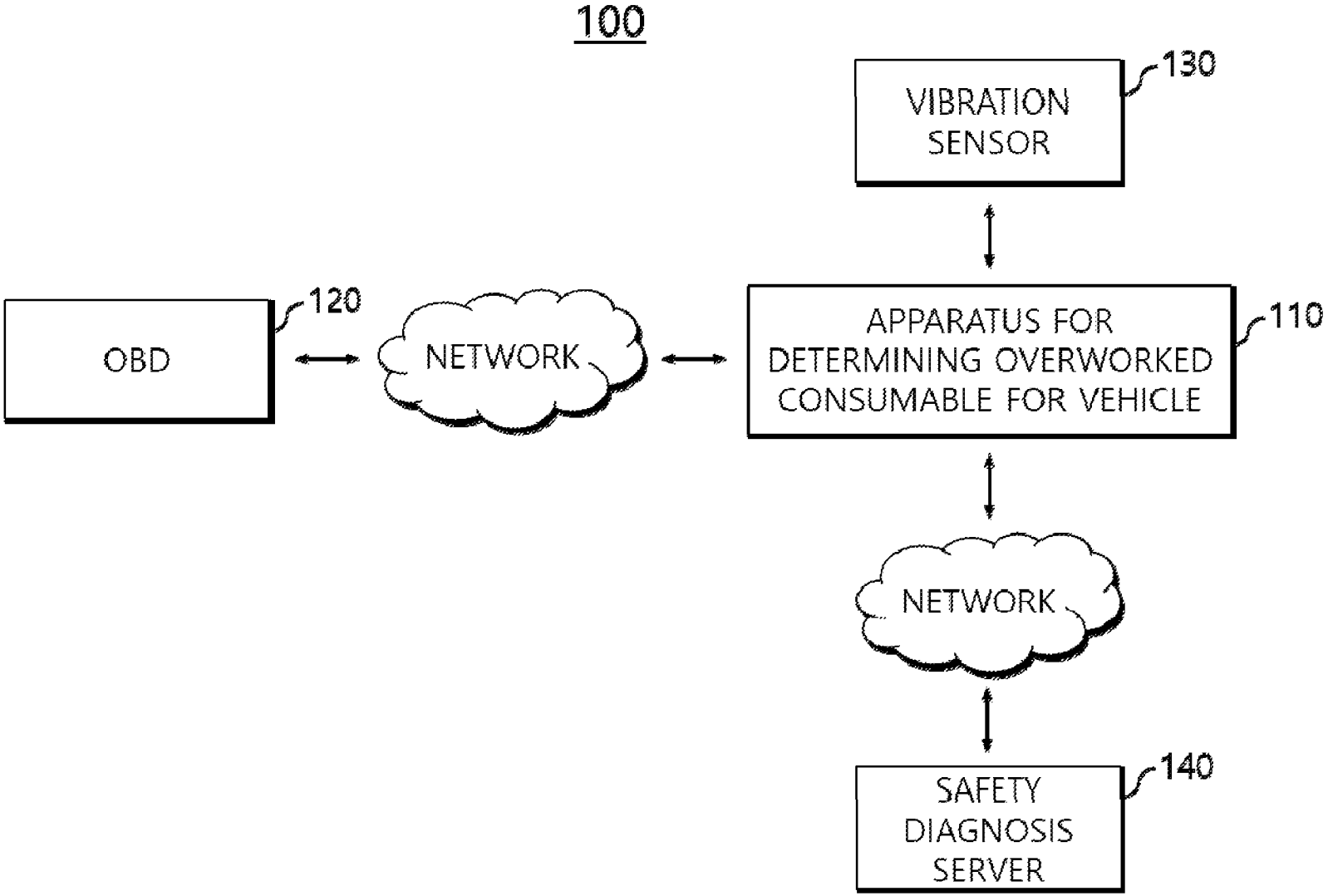
FIG. 1 is a diagram illustrating a system for determining an overworked consumable for a vehicle according to an embodiment of the present disclosure.

The description in the present disclosure is only embodiments for structural and functional description, so the scope of a right of the present disclosure should not be construed as being limited by the embodiments described herein. That is, embodiments may be changed and modified in various ways, so the scope of a right of the present disclosure should be understood as including equivalents that can achieve the spirit of the present disclosure. Further, the objects or effects proposed herein do not mean that the objects or effects should be all included in a specific embodiment or only the effects should be included in a specific embodiment, so the scope of a right of the present disclosure should not be construed as being limited by the objects or effects.

Meanwhile, terms used herein should be understood as follows.

Terms "first", "second", etc. are provided for discriminating one component from another component and the scope of a right is not limited to the terms. For example, the first component may be named the second component, and vice versa.

It is to be understood that when one element is referred to as being "connected to" another element, it may be connected directly to another element or be connected to another element, having the other element intervening therebetween. On the other hand, it is to be understood that when one element is referred to as being "connected directly to" another element, it may be connected to or coupled to another element without the other element intervening therebetween. Meanwhile, the terms used herein to describe a relationship between elements, that is, "between", "directly between", "adjacent" or "directly adjacent" should be interpreted in the same manner as those described above.

Singular forms should be understood as including plural forms unless the context clearly indicates otherwise, and it will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

In each step, reference characters (e.g., a, b, and c) are used for convenience without determining the order of each step, and each step may occur different from the orders described herein unless specific orders are clearly described in contexts. That is, each step may occur in the order described herein, may be substantially simultaneously performed, or may be performed in a reverse order.

The present disclosure may be achieved as computer-readable codes in a computer-readable recording medium and the computer-readable recording medium includes all kinds of recording devices in which data that can be read out by a computer system are stored. The computer-readable recording medium, for example, may be a ROM, a RAM, a CD-ROM, a magnetic tape, a floppy disk, an optical data storage device, etc. Further, the computer-readable recording media may be distributed to computer systems that are connected through a network and may store and execute computer-readable codes in the type of distribution.

As used in this specification, terms "vehicle", "vehicular", or other terms are understood as including vehicles, passenger automobiles generally including sports utility vehicles (SUV), buses, trucks, various commercial vehicles, various boats, ships, vessels, airplanes, etc., and including hybrid vehicles, electric vehicles, hybrid electric vehicles, hydrogen vehicles, and other vehicles using alternative fuel (fuel obtained from resources other than oil). As stated in this specification, an electric vehicle (EV) including electric power obtained from a chargeable energy storage device (e.g., one or more rechargeable electrochemical cells or other types of batteries) as a part of its locomotive capabilities. An EV is not limited to a vehicle and may include motor cycles, carts, and scooters. Further, a hybrid vehicle is a vehicle having two or more power sources, for example, gasoline-based power and electricity-based power (e.g., a hybrid electric vehicle (HEV)).

Unless otherwise defined, all terms used herein have the same meaning as commonly understood by those skilled in the art to which the present disclosure belongs. It will be further understood that terms defined in dictionaries that are commonly used should be interpreted as having meanings that are consistent with their meanings in the context of the relevant art and will not be interpreted in an idealized or overly formal sense unless expressly so defined herein.

FIG. 1 is a diagram illustrating a system for determining an overworked consumable for a vehicle according to an embodiment of the present disclosure.

Referring to FIG. 1, a system 100 for determining an overworked consumable for a vehicle includes an apparatus 110 for determining an overworked consumable for a vehicle, an OBD 120, a vibration sensor 130, and a safety diagnosis server 140.

An apparatus 110 for determining an overworked consumable for a vehicle includes: a vehicle information receiver 210 that receives vehicle information thorough the OBD 120; an overwork condition determiner 220 that receives vibration information through at least one vibration sensor 130 installed at a specific position in a vehicle and determines at least one of a plurality of overwork condition types on the basis of the vehicle information and the vibration information; an overworked consumable determiner 230 that determines at least one overworked consumable on the basis of the determined at least one overwork condition type; an overwork condition informer 240 that provides the type of a corresponding overwork condition to an automotive AVN (Audio Video Navigation) by detecting that a vehicle arrives around places of overwork condition types by tracking movement of the vehicle; a consumable replacement cycle predictor 250 that predicts a replacement cycle by calculating the accumulated amount of overwork degree of at least one overworked consumable on the basis of the overwork conditions; and a controller 260 that manages mutual data exchange and control flow.

The apparatus 110 for determining an overworked consumable for a vehicle can determine an overwork condition type on the basis of vehicle information and vibration information and can determine and provide an overworked consumable according to the overwork condition type to a driver. The vehicle information receiver 210, the overwork condition determiner 220, the overworked consumable determiner 230, overwork condition informer 240, consumable replacement cycle predictor 250, and the controller 260 are described in detail with reference to FIG. 2.

The OBD 120, which is a device that diagnoses the state of a vehicle and gives a notice of the result, may include a sensor for various items of measurement and control and an OBD controller. For example, the OBD 120 may include an accelerator pedal sensor, a brake pedal sensor, and a low-flow rate sensor that are fundamentally mounted on vehicle that are recently manufactured. Further, the OBD 120 may include a console or a terminal to be able to provide information about main systems of a vehicle, which is transmitted to the OBD controller from various sensors attached to the vehicle, or information such as breakdown to a driver using a serial communication function.

The vibration sensor 130 may include an engine vibration sensor attached to a timing belt, a knuckle vibration sensor including a plurality of 3-axis wheel acceleration sensors attached to a knuckle, and a car body vibration sensor including a car body acceleration sensor attached to the center of the lower end of a car body, a 6-axis rotation angle sensor, a 2-axis inclinometer sensor, and a GPS sensor.

In an embodiment, the knuckle vibration sensor may be attached to a plurality of steering knuckles in a vehicle. The knuckle vibration sensor may include a multi-axis wheel acceleration sensor, and can sense wheel vibration and transmit a vibration signal to the vehicle information receiver 210.

In an embodiment, at least one car body sensor may be attached to the lower end of the center of the car body of a vehicle. The car body sensor may include a multi-axis acceleration sensor, a multi-axis rotation angle sensor, a multi-axis gyro (inclination angle) sensor, and a GPS sensor. The car body sensor can sense vibration of a car body and transmit a vibration signal to the vehicle information receiver 210.

The safety diagnosis server 140 may be a storage device that can store various items of information needed for determining overworked consumables for a vehicle. The safety diagnosis server 140 can store information about a vehicle and various consumables constituting the vehicle and can store a plurality of sensing values received from the vehicle. However, the safety diagnosis server 140 is not necessarily limited thereto and may store information collected and processed in various types in the process of determining overworked consumables for a vehicle on the basis of a plurality of sensing values. For example, the safety diagnosis server 140 can store overwork condition types, which are determined on the basis of the vehicle information received from the OBD 120, and vibration information received from the vibration sensor 130, and GPS information.

The safety diagnosis server 140 may be composed of at least one or more independent sub-databases storing information pertaining to a specific range and may be an integrated database in which the independent sub-databases are integrated. When the safety diagnosis server 140 is composed of at least one or more independent sub-databases, the sub-databases may be connected wirelessly through Bluetooth, WiFi, etc., and can exchange heat with each other through a network. When the safety diagnosis server 140 is an integrated database, it may include a server controller that integrates the sub-databases and manages data exchange and control flow between them.

The network may be network corresponding to a group of terminals, links, and nodes that can exchange data by wirelessly connecting the apparatus 110 for determining an overworked consumable for a vehicle with the OBD 120 and the safety diagnosis server 140 through Bluetooth, WiFi, etc. The network can distribute information to a plurality of terminals and apparatuses and is an on-line real-time computer-using network as a sub-system, and may include a communication sub-network including a computer-based resource and an interface as a network.

Figure 2:
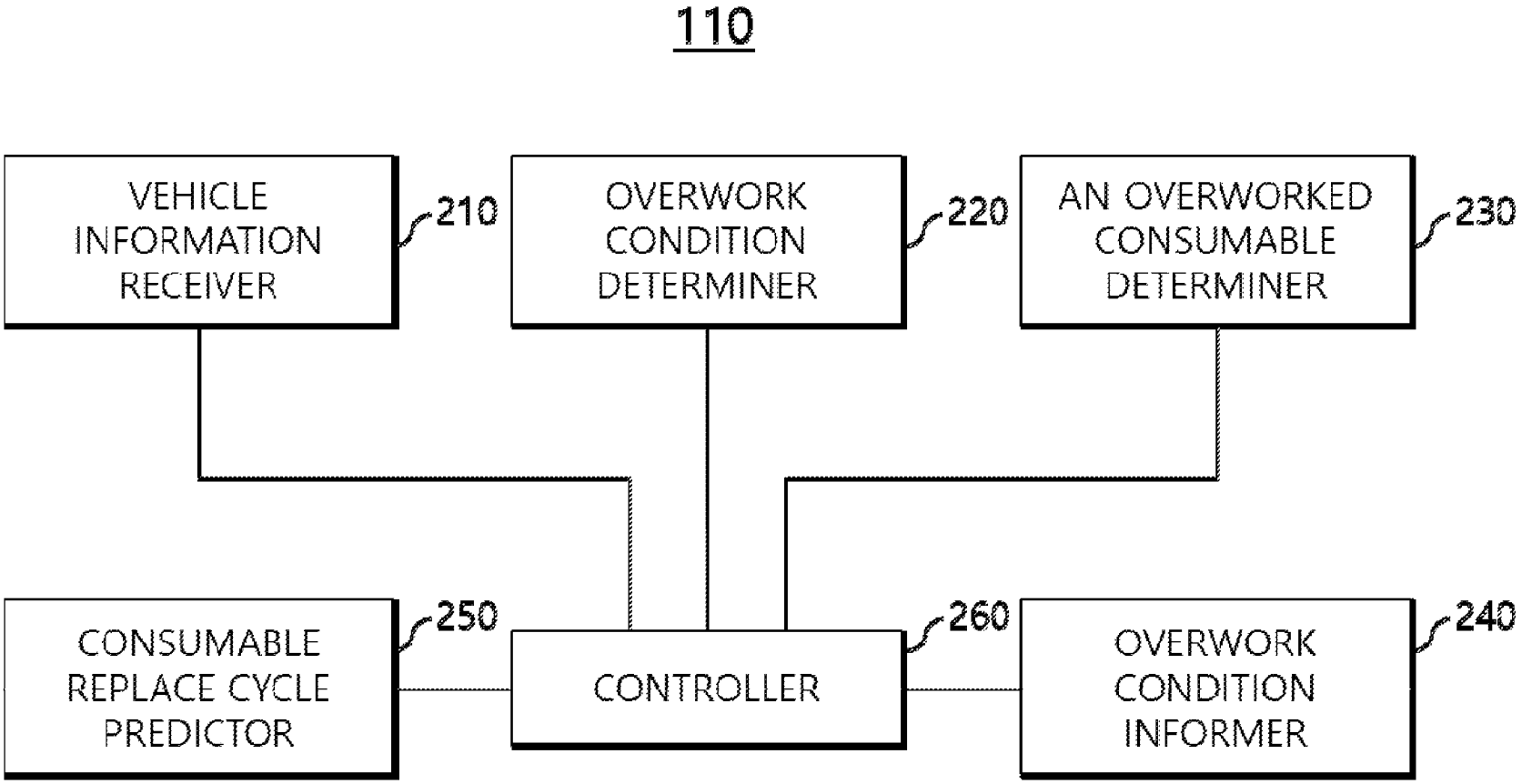
FIG. 2 is a block diagram illustrating an apparatus for determining an overworked consumable for a vehicle shown in FIG. 1.

FIG. 2 is a block diagram illustrating an apparatus for determining an overworked consumable for a vehicle shown in FIG. 1.

Referring to FIG. 2, the apparatus 110 for determining an overworked consumable for a vehicle includes a vehicle information receiver 210, an overwork condition determiner 220, an overworked consumable determiner 230, an overwork condition informer 240, a consumable replace cycle predictor 250, and a controller 260.

The vehicle information receiver 210 can receive sensing values from sensors for various items of measurement and control through the OBD controller and the network. The standardized OBD 120 can provide information about breakdown, etc. of a vehicle to a terminal through a network and can check vehicle information about breakdown, etc., using a driver or user terminal.

In an embodiment, the vehicle information receiver 210 can integrate an engine vibration signal, a knuckle vibration signal, and a car body vibration signal received from a vehicle, and can receive vehicle information provided from an ECU (Electronic Control Unit) corresponding to the OBD controller through an OBD II connector. The vehicle information may include diagnosis information of consumables and parts of a vehicle. The ECU (Electronic Control Unit) can provide vehicle information needed for determining overworked consumables for a vehicle to the vehicle information receiver 210 through the OBD II connector.

The overwork condition determiner 220 can receive vibration information through the wheel acceleration sensor attached to the knuckle, and a car body acceleration sensor and a car body gyro (inclination angle) sensor that are attached to the bottom of the lower end of the car body. The overwork condition determiner 220 can obtain a vehicle speed, a wheel speed, a vehicle temperature, and GPS information as vehicle information, and can obtain wheel acceleration, car body acceleration, and a car body angular speed as vibration information. When an overwork condition type is determined, the overwork condition determiner 220 can register a place for the overwork condition type by providing a corresponding place related to GPS information to the vehicle safety diagnosis server.

In an embodiment, the overwork condition determiner 220 can separate a normal complex vibration signal from a noise vibration signal on the basis of a frequency band. The overwork condition determiner 220 may include an overwork condition determination algorithm that compares of a normal complex vibration signal of a vehicle that is being driven and the database of the safety diagnosis server 140.

The overworked consumable determiner 230 can provide the type of an overwork condition and a severe overworked consumable having the shortest replacement cycle of at least one overworked consumable to an automotive AVN (Audio Video Navigation). The overworked consumable determiner 230 can determine a vehicle consumable that is influenced by the type of a corresponding overwork situation as an overworked consumable on the basis of the database of the safety diagnosis server 140 registered in advance for respective overwork condition types. For example, when the overwork condition determiner 220 determines an overwork condition type on the basis of short distance-repeated driving frequency, the overworked consumable determiner 230 may determine engine oil, an oil filer, a brake disc, and a brake pad as the consumables that are influenced by the overwork condition type on the basis of the database of the safety diagnosis server 140 registered in advance.

The overwork condition informer 240 can give notice to a driver by providing the overwork condition type, the overworked consumables, the places for the overwork condition type, etc. to the automotive AVN (Audio Video Navigation. For example, the overwork condition informer 240 can provide various items of information created in the process of determining consumables for a vehicle in a message type through push notice of an automotive navigation. As another example, the overwork condition informer 240 can provide various items of information created in the process of determining consumables for a vehicle in a sound type using TTS (Text to Speech) through an automotive audio.

Further, the automotive AVN (Audio Video Navigation) or a terminal can provide various items of information created in the process of determining consumables for a vehicle such as an overwork condition type, an overworked consumable, a place for an overwork condition type, etc. by providing a search function to a driver or a user.

The consumable replace cycle predictor 250 can calculate a predicted replacement date of at least one overworked consumable every time an overwork condition is generated, and can inform a driver of the predicted replacement date through the overwork condition informer 240. For example, the consumable replace cycle predictor 250 can calculate a predicted replacement date of an overworked consumable using interpolation by reflecting a predicted replacement date under common conditions and a predicted replacement date under overwork conditions to a driving time under overwork conditions.

The controller 260 can control the general operation of the apparatus 110 for determining an overworked consumable for a vehicle, and can manage control flow or data flow among the vehicle information receiver 210, the overwork condition determiner 220, the overworked consumable determiner 230, the overwork condition informer 240, and the consumable replace cycle predictor 250.

Figure 3:
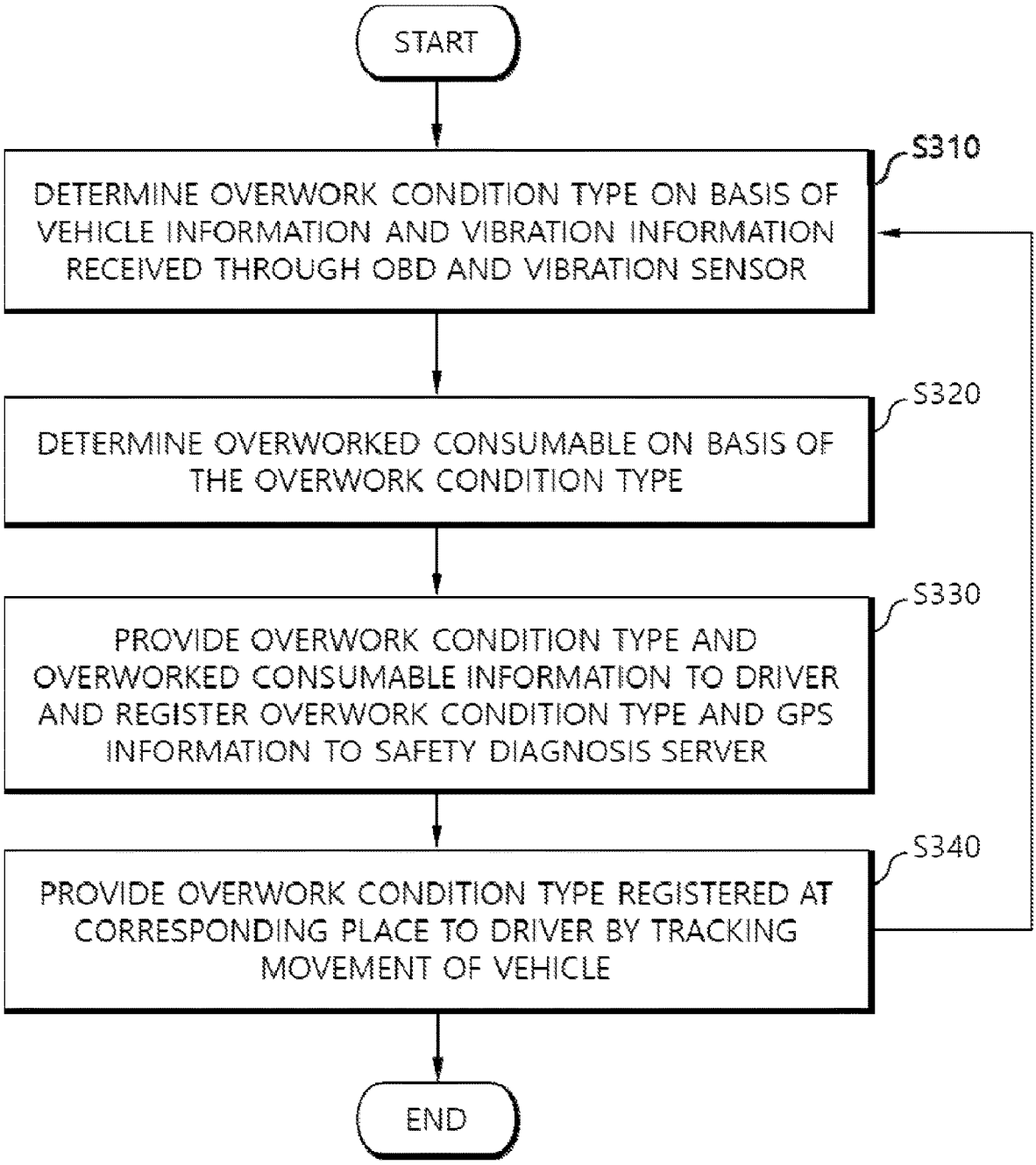
FIG. 3 is a flowchart illustrating a process of determining an overworked consumable for a vehicle that is performed in the apparatus for determining an overworked consumable for a vehicle shown in FIG. 1.

FIG. 3 is a flowchart illustrating a process of determining an overworked consumable for a vehicle that is performed in the apparatus for determining an overworked consumable for a vehicle shown in FIG. 1.

Referring to FIG. 3, the apparatus 110 for determining an overworked consumable for a vehicle can determine an overwork condition type on the basis of vehicle information and vibration information received through the OBD 120 and the vibration sensor 130 (step S310), and can determine an overworked consumable on the basis of the overwork condition type (step S320). The apparatus 110 can provide an overwork condition type and overworked consumable information to a driver and can register the overwork condition type and GPS information to the safety diagnosis server (step S330), and can provide an overwork condition type registered at a corresponding place to the driver by tracking movement of a vehicle (step S340).

FIG. 4 is a table showing examples of overwork condition types determined on the basis of vehicle information and vibration information in an overwork condition determiner of the apparatus for determining an overworked consumable for a vehicle shown in FIG. 2.

Referring to FIG. 4, overwork conditions include: a type when repeatedly driving a short distance (type 1), a type when driving an area with a lot of sand and dust (type 2), a type when continuously excessively idling (type 3), a type when driving over 50% of a place with heavy congestion at temperature over 32° C. (type 4), a type when frequently driving a rough road (sand/gravel road, snowy road, non-paved road), etc. (type 5), a type when frequently driving mountain path, uphill/downhill (type 6), a type when using as police car, taxi, commercial car, tow truck, etc. (type 7), a type when frequently driving at high speed (170 km/h) (type 8), a type when frequently repeating stop and start (type 9), and a type when driving salty area, corrosive area, or cold area (type 10).

As for the overwork condition type 1, the overwork condition type may be determined on the basis of a vehicle speed, vehicle acceleration, a wheel speed, wheel acceleration, and vehicle information and vibration information received from a GPS and a vehicle power sensor. The consumable replace cycle predictor 250 can calculate a predicted replacement date using interpolation by receiving specific weight, a contribution degree, and an overwork degree for each of overworked consumables that are influenced by overwork condition types.

In an embodiment, the consumable replace cycle predictor 250 can calculate an overwork degree for each overworked consumable using the following formulae (formulae 1 to 3) to calculate predicted replacement dates of overworked consumables according to overwork condition types.

$$M_j = \sum_{i=1}^{I} M_{jL} \quad \text{[Formula 1]}$$

where M is a driving distance of a vehicle. $M_j$ is a driving distance that a vehicle has driven under a j overwork condition type of J different kinds of overwork condition types $M_{ji}$ is an i-th driving distance that a vehicle has driven in driving sections divided into I sections under the j overwork condition type of $M_j$.

$$S_j = \sum_{i=1}^{I} W_{ji} M_{ji} C_{ji} \quad \text{[Formula 2]}$$

where S is an overwork degree of a vehicle. $S_j$ is an overwork degree of a vehicle when the vehicle is driven in a j overwork condition type of J different kinds of overwork condition types. $M_{ji}$ is an i-th driving distance that a vehicle has driven in driving sections divided into I sections under the j overwork condition type of $M_j$. $W_{ji}$ is a specific weight constant for the i-th driving section of driving sections divided into i sections under the j overwork condition type. $W_{ji}$ is a contribution degree for the i-th driving section of driving sections divided into i sections under the j overwork condition type.

Accordingly, the entire overwork degree of a vehicle can be shown as the sum of $S_T$ and $S_j$.

$$S_T = \sum_{j=1}^{J} S_j \quad \text{[Formula 3]}$$

where $S_T$ is the entire overwork degree which is the sum of $S_j$s to the j-th overwork condition in the J overwork condition types.

Figure 5:
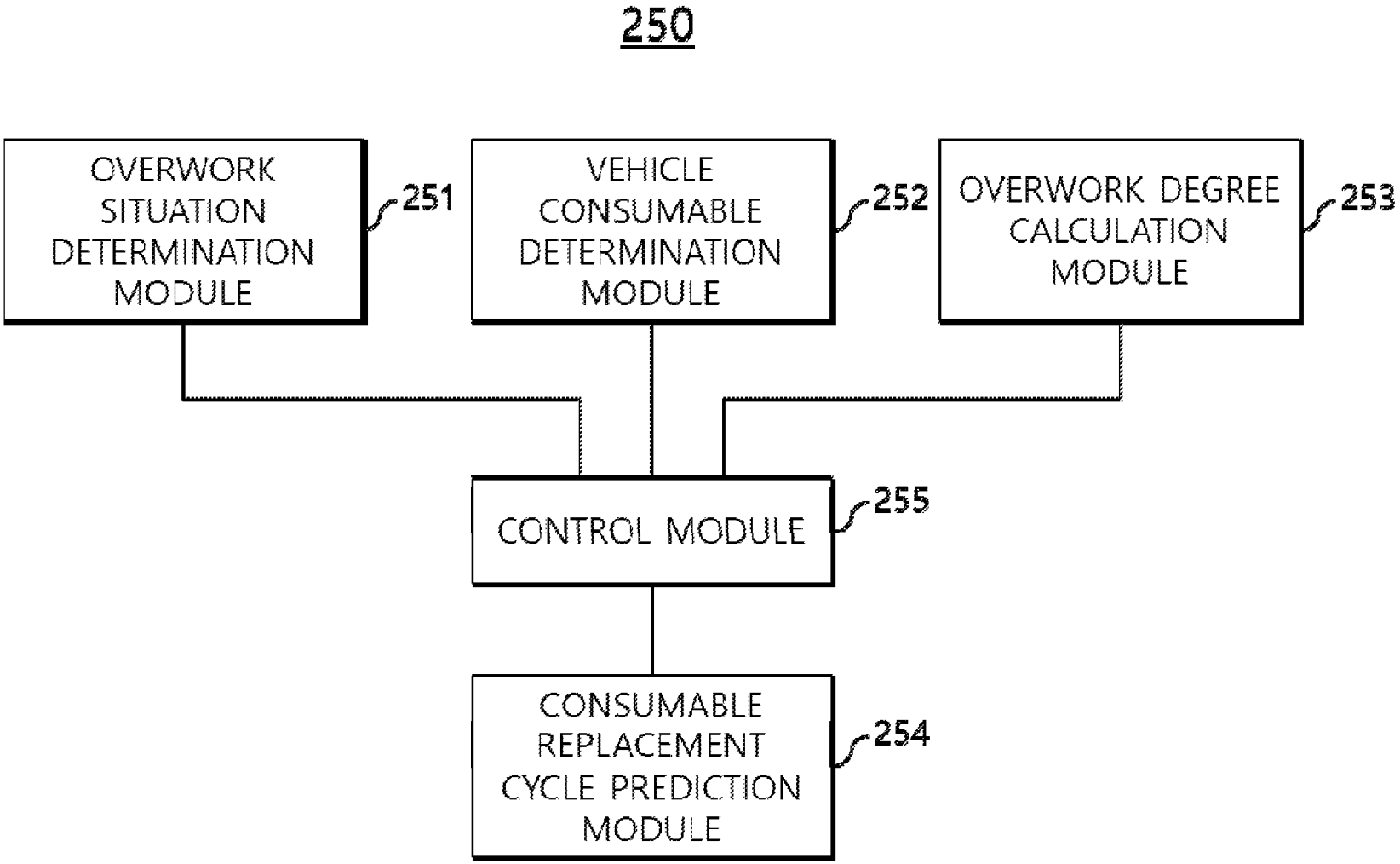
FIG. 5 is a block diagram illustrating a consumable replacement cycle predictor shown in FIG. 2.

FIG. 5 is a block diagram illustrating a consumable replacement cycle predictor shown in FIG. 2.

Referring to FIG. 5, the apparatus 110 for determining an overworked consumable for a vehicle can predict a replacement cycle by calculating the accumulated amount of overwork degree of at least one overworked consumable no the basis of an overwork condition through the consumable replace cycle predictor 250. The consumable replace cycle predictor 250 may include an overwork situation determination module 251, a vehicle consumable determination module 252, an overwork degree calculation module 253, a consumable replacement cycle prediction module 254, and a control module 255.

The overwork situation determination module 251 can determine occurrence of an overwork situation on the basis whether a corresponding driving condition corresponds to an overwork condition every time the driving condition of a vehicle changes while the vehicle is driven. The overwork situation determination module 251 can find out short distance-repeated driving frequency of a vehicle on the basis of data detected from the wheel acceleration sensor, the car body acceleration sensor, and the GPS sensor, and can determine an overwork situation when the corresponding driving condition corresponds to an overwork condition by comparing the frequency with database input in advance.

The vehicle consumable determination module 252 can determine a vehicle consumable that is influenced by the type of an overwork situation as a problematic vehicle consumable ever type an overwork situation occurs. For example, when the overwork situation determination module 251 determines that an overwork situation has occurred on the basis of short distance-repeated driving frequency, the vehicle consumable determination module 252 can determine engine oil, an oil filter, a brake disc, and a brake pad as consumables that are influenced by the corresponding overwork situation on the basis of database input in advance.

The overwork degree calculation module 253 can calculate a individual overwork degree by reflecting individual contribution degrees according to at least one corresponding overwork situation for a problematic vehicle consumable. In an embodiment, the overwork degree calculation module 253 can calculate individual overwork degrees by reflecting individual contribution degrees according to at least one corresponding overwork situation that has occurred up to now after previous replacement of a specific problematic vehicle consumable, and can calculate an overwork degree by summing up the individual overwork degrees. In an embodiment, the overwork degree calculation module 253 can calculate individual contribution degrees in accordance with how much a driving condition of a vehicle coincides with an overwork situation.

In more detail, the overwork degree calculation module 253 calculates an individual contribution degree of an overwork situation that influences a specific problematic vehicle consumable using interpolation on the basis of how much a driving condition of a vehicle coincides with the overwork situation. For example, the contribution degree of an overwork situation according to high-speed driving frequency can be expressed as a function having one parameter (i.e., a vehicle speed). In this case, the contribution degree condition may be defined in advance as 100% when the vehicle speed is over 200 km/h or more and as 0% when the vehicle speed is less than 80 km/h, in which when the vehicle speed is 140 km/h, the contribution degree may be 50% by linear interpolation.

As another example, the contribution degree of an overwork situation according to driving frequency on a rough road, it can be expressed as a function having two or more parameters (i.e., car body vibration and slip ratio). In this case, the contribution degree condition may be defined in advance as 100% when the root means square (RMS) of car body vibration is 0.5 G or more, 0% when the RMS is less than 0.2 G, and 100% when the slip ratio is 0.2 or more, and 0% when the slip ratio is less than 0.02. In this case, the contribution degree can be calculated as the average value of the RMS contribution degree and the slip ratio contribution degree or can be calculated by defining specific weight according to an individual contribution degree by considering the specific weight.

The overwork degree calculation module 253 can calculate individual overwork degrees on the basis of individual overwork situation contribution degrees that influence a specific problematic vehicle consumable up to now after previous replacement, and can calculate an overwork degree by summing up them. For example, an individual overwork degree can be calculated from the following formula 4.

$$S_j = \sum_{i=1}^{I} W_{ji} M_{ji} C_{ji} / M\ Nd \qquad \text{[Formula 4]}$$

where $W_{ji}$ is specific weight in an i-th section, $M_{ji}$ is a driving distance in the i-th section, $C_{ji}$ is a contribution degree in the i-th section, and Nd is $\Sigma_{i=1}^{I} W_{ji}$ when the occurrence times of individual overwork conditions do not overlap, and is $\Sigma_{i=1}^{I} W_{ji}/\Sigma_{i=1}^{I} M_{ji}$ when the occurrence times of individual overwork conditions overlap. The specific weight may be differently defined, depending on the degree of an individual overwork situation influencing a specific problematic vehicle consumable. Further, the overwork degree (ST) can be calculated from the following formula 5 by summing up individual overwork degrees.

$$S_T = \sum_{i=1}^{I} S_i \qquad \text{[Formula 5]}$$

where $S_T$ is the entire overwork degree which is the sum of $S_i$s to the i-th overwork condition in the i overwork condition types.

The consumable replacement cycle prediction module 254 can dynamically predict a replacement cycle of a specific problematic vehicle consumable on the basis of a calculated overwork degree. The consumable replacement cycle prediction module 254 can transmit the replacement cycle of a specific problematic vehicle consumable at an overwork degree, which is calculated by interpolating the replacement cycle under common conditions and the replacement cycle under overwork conditions input in a database in advance on the basis of the calculated overwork degree, to a user device through a network.

In an embodiment, the consumable replacement cycle prediction module 254 can determine a replacement time or a replacement distance as a replacement time and a replacement distance under an overwork situation when an overwork degree is larger than a first overwork degree, can determine a replacement time or a replacement distance according to an overwork degree by interpolating a replacement time or a replacement distance under an overwork condition and a replacement time or a replacement distance under a common condition when the overwork degree is smaller than the first overwork degree and larger than a second overwork degree, can determine a replacement time or a replacement distance as a replacement time or a replacement distance under a common condition when the overwork degree is smaller than the second overwork degree, can calculate a remaining replacement time or a remaining replacement distance using a replacement time or a replacement distance and a driving time or a driving distance up to now after previous replacement of a consumable, and can give notice of a replacement time by transmitting the remaining replacement time or the remaining replacement distance to a user terminal.

In an embodiment, the consumable replacement cycle prediction module 254 can reduce the replacement lifespan by reflecting a calculated overwork degree to a replacement lifespan corresponding to a replacement time or a replacement distance of a specific problematic vehicle consumable.

In an embodiment, the consumable replacement cycle prediction module 254 can determine a replacement lifespan by interpolating a replacement lifespan under an overwork condition and a replacement lifespan under a common condition in accordance with an overwork degree.

The control module 255 can control the general operation of the consumable replace cycle predictor 250 and can manage control flow or data flow among the overwork situation determination module 251, the vehicle consumable determination module 252, the overwork degree calculation module 253, and the consumable replacement cycle prediction module 254.

Figure 6:
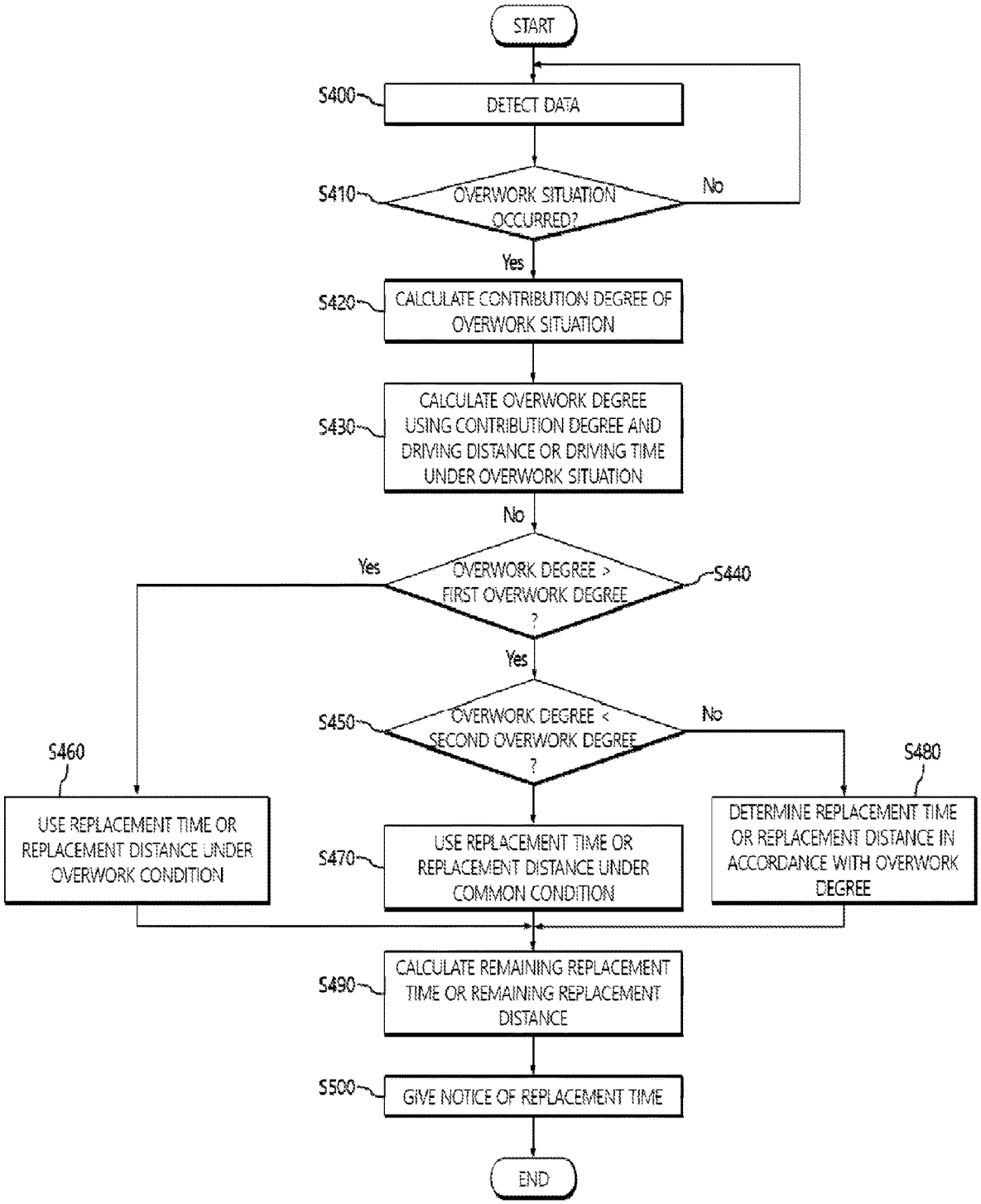
FIG. 6 is a flowchart illustrating a process of automatically managing replacement cycles of overworked consumables for a vehicle that is performed in the apparatus for determining an overworked consumable for a vehicle shown in FIG. 1.

FIG. 6 is a flowchart illustrating a process of automatically managing replacement cycles of overworked consumables for a vehicle that is performed in the apparatus for determining an overworked consumable for a vehicle shown in FIG. 1.

Referring to FIG. 6, the process of automatically managing replacement cycles of overworked consumables for a vehicle is composed of a total of 10 steps from a data detection step (S400) to a replacement time notice step (S500).

In the data detection step (S400), the OBD 120 detects a sensing value by monitoring the states of various parts of a vehicle.

In an overwork situation occurrence determination step (S410), data detected by the OBD 120 are transmitted to the apparatus 110 for determining an overworked consumable for a vehicle through a network. The overwork situation determination module 251 of the apparatus 110 for determining an overworked consumable for a vehicle determines whether it corresponds to a pre-defined overwork situation by analyzing the transmitted data, and the vehicle consumable determination module 252 determines a vehicle consumable that is influenced by the corresponding overwork situation as a problematic vehicle consumable. Wien an overwork situation does not occur, this step returns to the step S400 and the OBD 120 keeps detecting data. When an overwork situation occurs, it goes to the step S420.

In an overwork situation contribution degree calculation step (S420), the overwork degree calculation module 253 calculates the contribution degree of an occurring overwork situation. In this case, the overwork situation contribution degree means how well the overwork condition according to a detected sensing value coincides with the overwork situation.

In an overwork degree calculation step (S430), the overwork degree calculation module 253 calculates individual overwork degrees and calculates an overwork degree by summing up them, as described with reference to FIG. 5. In this case, the overwork degree is calculated in consideration of a driving distance under an overwork situation, the contribution degree of an overwork situation, and the weight of an overwork situation influencing a specific problematic vehicle consumable, and means the degree of influence on the specific problematic vehicle consumable by the overwork situation.

In a first overwork degree determination step (S440), the overwork degree calculation module 253 goes to step S460 when the calculated overwork degree is larger than the first overwork degree, and if not so, goes to a step S450.

In a second overwork degree determination step (S450), the overwork degree calculation module 253 goes to step S470 when the calculated overwork degree is smaller than the first overwork degree, and if not so, goes to a step S480.

In a first replacement time or replacement distance determination step (S460), the overwork degree calculator 240 determines a replacement time ($T_c$) or a replacement distance ($M_c$) as the replacement time ($T_1$) or the replacement distance ($M_1$) under an overwork situation.

In step of using a replacement time or a replacement distance under a common condition (S470), the overwork degree calculation module 253 determines the replacement time ($T_c$) or the replacement distance ($M_c$) as the replacement time ($T_2$) or the replacement distance ($M_2$) under a common condition.

In a second replacement time or replacement distance determination step (S480), the overwork degree calculation module 253 determines the replacement time ($T_c$) or the replacement distance ($M_c$) according to the overwork degree by interpolating the replacement time ($T_1$) or the replacement distance ($M_1$) under an overwork situation and the replacement time ($T_2$) or the replacement distance ($M_2$) under a common condition.

In a remaining replacement time or remaining replacement distance calculation step (S390), the consumable replacement cycle prediction module 254 calculates a remaining replacement time ($T_r$) or a remaining replacement distance ($M_r$) using the replacement time ($T_c$) or the replacement distance ($M_c$) and a driving time (T) or a driving distance (M) up to now after previous replacement of a consumable. For example, the consumable replacement cycle prediction module 254 can calculate the remaining replacement time ($T_r$) by subtracting the driving distance (T) up to now after previous replacement of a consumable from the replacement time ($T_c$) or can calculate the remaining replacement distance ($M_r$) by subtracting the driving distance up to now after previous replacement of a consumable from the replacement distance ($M_c$).

In the replacement time notice step (S400), the consumable replacement cycle prediction module 254 transmits the remaining replacement time and the remaining replacement distance to a user device through a network and the user device informs a user of information about the replacement time and necessity of maintenance of a consumable. Further, when the remaining replacement time ($T_r$) is smaller than a critical time or the remaining replacement distance ($M_r$) is smaller than a critical distance, the consumable replacement cycle prediction module 254 can turn on a warning light or generate a warning sound on the user device.

FIG. 7 is a diagram showing an example of contribution degrees set in advance for overwork situations that occur in driving of a vehicle.

Referring to FIG. 7, the weight of the overwork situation when repeatedly driving a short distance is defined as 1, but the weight of the overwork situation when continuously excessively idling is defined as 3. This means that the overwork situation when continuously excessively idling influences an overwork degree three times than the overwork situation when repeatedly driving a short distance. Further, the weights may be used not only when the overwork situations occur, but when the occurrence times of the overwork situations overlap. The weights may be defined in advance through big data analysis. The weights shown in FIG. 7 may correspond to one embodiment or different weights may be determined.

FIG. 8 is a diagram showing maintenance target items and an example of changed replacement times thereof.

Referring to FIG. 8, as for the vehicle B, referring to step S440, when the overwork degree is larger than the first overwork degree, the replacement time of an air cleaner filter is 20,000 km. As another example, as for the vehicle B, referring to step S440, when the overwork degree is larger than the first overwork degree, the replacement time of a timing belt is 80,000 km.

Further, as for the vehicle B, referring to step S450, when the overwork degree is smaller than the second overwork degree, the replacement time of an air cleaner filter is 40,000 km. As another example, as for the vehicle A, referring to step S450, when the overwork degree is smaller than the second overwork degree, the replacement time of a timing belt is 160,000 km.

Consequently, the apparatus 110 for determining an overworked consumable for a vehicle determines whether a corresponding driving condition is an overwork situation on the basis of the sensing values detected by the OBD 120, and if so, can specify a consumable that is influenced under the overwork situation as a problematic vehicle consumable, calculate an overwork degree influencing the corresponding consumable, and inform a user of information about the replacement time and necessity of maintenance of the consumable through an interface.

Further, the apparatus 110 for determining an overworked consumable for a vehicle can rest all driving distances or driving times when acceleration consumables are replaced, and the driving time or the driving distance after previous replacement of the consumables and the driving distance or the driving time under an overwork condition after previous replacement of the consumable can be accumulated again.

The present disclosure can have the following effects. However, a specific embodiment is not intended to have to include all of the following effects or only the following effects, so the scope of a right of the present disclosure should not be construed as being limited by the embodiment.

The apparatus for determining an overworked consumable for a vehicle according to an embodiment of the present disclosure determines overwork condition types on the basis of vehicle information and vibration information, and determines and provides overworked consumables according to the overwork condition types to a driver.

The apparatus for determining an overworked consumable for a vehicle according to an embodiment of the present disclosure can register places for overwork condition types by providing corresponding places related to GPS information to a vehicle safety diagnosis server when the overwork condition types are determined, and can inform a driver that a vehicle arrives around the places for the overwork condition types through an automotive AVN (Audio Video Navigation) by tracking movement of the vehicle.

The apparatus for determining an overworked consumable for a vehicle according to an embodiment of the present disclosure can inform a driver of the types of overwork conditions and a severely overworked consumable having the shortest replacement cycle of overworked consumables through an automotive AVN (Audio Video Navigation).

The apparatus for determining an overworked consumable for a vehicle according to an embodiment of the present disclosure can calculate a predicted replacement date of an overworked consumable when an overwork condition is generated, and can inform a driver of the replacement date through an OBD.

Although the present disclosure was described above with reference to exemplary embodiments, it should be understood that the present disclosure may be changed and modified in various ways by those skilled in the art, without departing from the spirit and scope of the present disclosure described in claims.

What is claimed is:

1. An apparatus for determining an overworked consumable for a vehicle, the apparatus comprising:

a vehicle information receiver that receives vehicle information thorough an OBD (On-Board Diagnostics) port;

an overwork condition determiner that receives vibration information through at least one vibration sensor installed at a specific position in the vehicle and determines at least one of a plurality of overwork condition types on the basis of the vehicle information and the vibration information;

an overworked consumable determiner that determines at least one overworked consumable on the basis of the determined at least one overwork condition type; and a consumable replacement cycle predictor that predicts a replacement cycle by calculating an accumulated amount of overwork degree of at least one overworked consumable on the basis of the overwork condition, wherein the consumable replacement cycle predictor includes:

an overwork situation determination module that determines occurrence of an overwork situation on the basis whether a corresponding driving condition corresponds to an overwork condition every time a driving condition of the vehicle changes while the vehicle is driven;

a vehicle consumable determination module that determines a problematic vehicle consumable in accordance with the type of the overwork condition;

an overwork degree calculation module that calculates an individual overwork degree by reflecting individual contribution degrees according to at least one corresponding overwork situation for a problematic vehicle consumable; and a consumable replacement cycle prediction module that dynamically predicts a replacement cycle of a specific problematic vehicle consumable on the basis of the calculated overwork degree.

2. The apparatus of claim 1, wherein the overwork condition determiner receives the vibration information through a wheel acceleration sensor attached to a knuckle, and a car body acceleration sensor and a car body gyro sensor that are attached to a bottom of a lower end of the car body.

3. The apparatus of claim 1, wherein the overwork condition determiner obtains a vehicle speed, a wheel speed, a vehicle temperature, and GPS information as the vehicle information, and obtains wheel acceleration, car body acceleration, and a car body angular speed as the vibration information.

4. The apparatus of claim 1, wherein when an overwork condition type is determined, the overwork condition determiner registers a place for the overwork condition type by providing a corresponding place related to GPS information to a vehicle safety diagnosis server.

5. The apparatus of claim 4, further comprising an overwork condition informer that provides the type of a corresponding overwork condition to an automotive AVN (Audio Video Navigation) device by detecting that the vehicle arrives around places of overwork condition types by tracking movement of the vehicle.

6. The apparatus of claim 1, wherein the consumable replacement cycle predictor calculates a predicted replacement date of at least one overworked consumable every time an overwork condition is generated, and informs a driver of the predicted replacement date through the OBD port.

7. The apparatus of claim 1, wherein the overwork degree calculation module calculates individual overwork degrees by reflecting individual contribution degrees according to at least one corresponding overwork situation that has occurred up to a present time after previous replacement of the specific problematic vehicle consumable, and calculates an overwork degree by summing up the individual overwork degrees.

8. The apparatus of claim 7, wherein the overwork degree calculation module calculates the individual contribution degrees in accordance with how much a driving condition of the vehicle coincides with the overwork situation.

9. The apparatus of claim 1, wherein the consumable replacement cycle prediction module determines a replacement time or a replacement distance as a replacement time and a replacement distance under an overwork situation when the overwork degree is larger than a first overwork degree;

determines the replacement time or the replacement distance according to an overwork degree by interpolating a replacement time or a replacement distance under an overwork condition and a replacement time or a replacement distance under a common condition when the overwork degree is smaller than the first overwork degree and larger than a second overwork degree;

determines the replacement time or the replacement distance as a replacement time or a replacement distance under a common condition when the overwork degree is smaller than the second overwork degree;

calculates a remaining replacement time or a remaining replacement distance using the replacement time or the replacement distance and a driving time or a driving distance up to a present time after previous replacement of a consumable; and gives notice of a replacement time by transmitting the remaining replacement time or the remaining replacement distance to a user terminal.

10. The apparatus of claim 1, wherein the consumable replacement cycle prediction module reduces the replacement lifespan by reflecting the calculated overwork degree to a replacement lifespan corresponding to a replacement time or a replacement distance of the specific problematic vehicle consumable.

11. The apparatus of claim 10, wherein the consumable replacement cycle prediction module determines the replacement lifespan by interpolating a replacement lifespan under an overwork condition and a replacement lifespan under a common condition in accordance with the overwork degree.

* * * * *